US005910045A

United States Patent [19]

Aoki et al.

[11] Patent Number: 5,910,045

[45] Date of Patent: Jun. 8, 1999

[54] AIR DISCHARGE UNIT FOR UNDERFLOOR AIR CONDITIONING AND UNDERFLOOR AIR CONDITIONING SYSTEM USING SAME

[75] Inventors: Keisuke Aoki; Kazuto Yamagata; Keigo Ando; Masashi Kamada; Kanjiro Kinoshita; Kansuke Kimura, all of Osaka, Japan

[73] Assignee: Daikin Industries, Ltd., Osaka, Japan

[21] Appl. No.: 09/043,033

[22] PCT Filed: Sep. 6, 1996

[86] PCT No.: PCT/JP96/02553

§ 371 Date: Mar. 6, 1998

§ 102(e) Date: Mar. 6, 1998

[87] PCT Pub. No.: WO97/09572

PCT Pub. Date: Mar. 13, 1997

[30] Foreign Application Priority Data

Sep. 7, 1995 [JP] Japan ..... 7-230509

[51] Int. Cl.[6] ..... F24F 7/007

[52] U.S. Cl. ..... 454/186; 454/233; 454/310; 454/329

[58] Field of Search ..... 454/186, 233, 454/236, 289, 310, 329

[56] References Cited

U.S. PATENT DOCUMENTS

| | | | |
|---|---|---|---|
| 2,808,237 | 10/1957 | Fosnes | 454/233 X |
| 4,730,551 | 3/1988 | Peludat | 454/233 |
| 4,809,593 | 3/1989 | Asselbergs | 454/329 X |
| 4,979,429 | 12/1990 | Soethout et al. | 454/310 X |
| 5,607,354 | 3/1997 | Mill et al. | 454/186 X |
| 5,632,677 | 5/1997 | Elkins | 454/329 |

FOREIGN PATENT DOCUMENTS

| | | | |
|---|---|---|---|
| 55-180995 | 6/1954 | Japan . | |
| 59-593 | 1/1984 | Japan . | |
| 60-249697 | 12/1985 | Japan . | |
| 63-196043 | 12/1988 | Japan . | |
| 4155145 | 5/1992 | Japan . | |
| 4-203833 | 7/1992 | Japan | 454/186 |
| 5-164394 | 6/1993 | Japan . | |
| 6-174260 | 6/1994 | Japan . | |
| 7-91730 | 4/1995 | Japan . | |

*Primary Examiner*—Harold Joyce
*Attorney, Agent, or Firm*—Birch, Stewart, Kolasch & Birch, LLP

[57] ABSTRACT

An air discharge unit (100) for underfloor air conditioning employs a centripetal fan (2) to realize low pressure loss, low noise and energy saving while reducing the heightwise thickness of the whole unit. The centripetal fan (2) is installed in an underfloor chamber (104) formed between a floor panel (103) and a floor slab to face an outlet (1) provided in the floor panel 103, and is driven by a motor (4). The centripetal fan (2) has a hub (200) and a plurality of blades (20) formed on an outer surface of the hub (200), and sucks therein an air in the underfloor chamber (104) from radially outward direction to make the air spirally flow toward the outlet (1) generally in an axial direction.

15 Claims, 12 Drawing Sheets

AIR DISCHARGE UNIT FOR UNDERFLOOR AIR CONDITIONING AND UNDERFLOOR AIR CONDITIONING SYSTEM USING SAME

TECHNICAL FIELD

The present invention relates to underfloor air-conditioning systems that are adopted in offices, computer rooms, various laboratories, stores, factories, hospitals, hotels, banquet halls, and other building facilities in various fields, and also relates to an air discharge unit applied to such a system.

BACKGROUND ART

The underfloor air-conditioning system is a system for performing indoor air conditioning, with an underfloor chamber formed between a floor slab and a floor panel, by feeding conditioned air from an air conditioner to the underfloor chamber and by discharging the conditioned air through an outlet or outlets provided in the floor panel.

FIG. 16 shows an example of conventional air discharge units to be used in such an underfloor air-conditioning system. This air discharge unit is disclosed in Japanese Utility Model Laid-Open Publication SHO 63-196043. In this unit, a cylindrical duct D is provided below an outlet O which opens in a floor panel A, with a lower-end opening of the cylindrical duct confronting a floor slab S. A discharge grille G enabled to adjust the angle of the discharged air stream is provided at an upper end of the duct D, while an axial fan FP constituted of a propeller fan driven by a motor M is provided inside the duct D. This fan FP makes up for the force with which the conditioned air is fed under pressure from an air conditioner (not shown) side to an underfloor chamber J provided below the floor panel A, so that the conditioned air can be smoothly fed to the indoor side.

However, the air discharge unit using the axial fan FP, in which the air is allowed to flow in an axial direction of the fan, tends to increase the heightwise thickness of the whole unit. Also, because the axial fan FP sucks air through the opening provided at the lower end of the duct D, there is a need for providing a space of a certain height below the duct D to introduce the air. This results in a problem since the air discharge unit using the axial fan FP needs a large installation space in the axial direction therefore, it is difficult to install in a limited narrow underfloor space. Another problem is that the unit involves noise having components of high frequencies, thus being harsh.

FIG. 17 shows an air discharge unit as disclosed in Japanese Patent Laid-Open Publication HEI 7-91730, which is particularly intended to thin the heightwise thickness of the unit. In FIG. 17, components similar to those shown in FIG. 16 are designated by the same reference symbols. In the air discharge unit shown in FIG. 17, a pair of crossflow fans FC, FC are placed in a confronting manner on opposite sides of a discharge grille G, so that air taken in sideways is bent upward by a partitioning plate P so as to reach the discharge grille G.

However, this air discharge unit using a pair of crossflow fans FC, FC, in which the air flow taken in sideways is forcedly bent upward by the partitioning plate P, is large in pressure loss. Moreover, although the unit can be thinned heightwise, the unit would be enlarged horizontally laterally. Therefore, there still exists a problem of poor installability.

As another example of the fan, centrifugal fans such as turbo fans or sirocco fans may be used. However, because this type of fan blows off air radially, it is necessary to form a flow path through which the radially blown air is lead toward the axial direction. This would cause the air discharge unit to be increased in size. This would also cause the pressure loss within the system to be increased, so that noise produced would be as big as, for example, 40–45 dB(A). To reduce this noise, it would be necessary to provide an array of air chambers of specified capacity, in which case the unit could not be downsized.

FIG. 18 shows still another example of the prior art, which is disclosed in Japanese Patent Laid-Open Publication HEI 5-106595. In this prior art, in order to attain a uniform room temperature distribution, air to be discharged from the outlet is formed into a rotational flow such that an air flow characteristic of good mixability with ambient room air is imparted to the discharged air. For this purpose, a discharge grille GS is provided with a multiplicity of slanted blades K intended to produce a rotational flow by forcedly bending the discharged air circumferentially as well as concentric slits L. The discharge grille GS is fitted to the outlet.

The discharge grille GS shown in FIG. 18 provides an advantage in that the room temperature distribution can be improved by the rotational flow, which in turn allows the cold draft to be reduced. However, due to the forced change of the direction of the discharged air, there are problems of a large pressure loss and increased noise.

There are known other means to positively reduce the cold draft, as shown in Japanese Patent Laid-Open Publication HEI 7-145985, in which a heater is disposed below the discharge grille so that the temperature of the discharged air is raised. This, however, is not an energy-saving method.

SUMMARY OF THE INVENTION

A primary object of the present invention is to provide an air discharge unit for underfloor air conditioning which is capable of realizing low pressure loss, low noise and energy saving while allowing reduction in heightwise thickness of the air discharge unit and improvement in installability. Furthermore, it is an object of the present invention to provide an underfloor air-conditioning system using such an air discharge unit.

In order to accomplish the above object, an air discharge unit for underfloor air conditioning according to the present invention includes:

an outlet provided in a floor panel;

a centripetal fan which has a hub and a plurality of blades formed on an outer surface of the hub, and which is disposed opposite to the outlet and within an underfloor chamber formed between the floor panel and a floor slab, and which, in operation, sucks therein air in the underfloor chamber from radially outside and delivers the sucked air generally axially toward the outlet; and a motor for driving the centripetal fan into rotation.

Since the centripetal fan takes air in from radially outside and blows air in a generally axial direction toward the outlet, there is no need to provide an air-introducing space below the air discharge unit, unlike the conventional air discharge unit employing the axial fan. Therefore, in comparison between the conventional air discharge unit employing an axial fan and the air discharge unit of the present invention, if the two air discharge units are of the same axial size, the air discharge unit of the present invention requires a smaller installation space in a height direction (in an axial direction). Accordingly, the air discharge unit of the present invention is suitable for installation in a limited underfloor space. The air discharge unit also allows a noise reduction to be attained even without providing any special air chamber, which would be involved in centrifugal fans. The elimination of the need of an air chamber in turn allows the air discharge unit itself to be made smaller and thinner.

Further, since a current of air discharged from the centripetal fan naturally is rotatory, there is no need to provide a discharge grille GS as shown in FIG. 18 for forcedly bending the air toward the discharge side. As a result, a reduction in pressure loss and a reduction in noise can be attained. Since the rotational flow of discharged air draws ambient room air in, the discharged air and the room air are sufficiently mixed together and moreover the discharge speed is appropriately reduced. Thus, the room temperature distribution is improved and the cold draft is reduced. Furthermore, since the cold draft is reduced even without using a heater, energy saving is also attained. Thus, according to the present invention, there is obtained a high-performance, thin-type air discharge unit which is convenient as an air discharge unit to be installed in a narrow space such as a chamber under a free-access floor.

In an embodiment, a leading edge of each blade of the centripetal fan is slanted such that a leading edge tip side is located axially more on the discharge side of the fan and radially more outside than a leading edge hub side is.

With such a slanted structure of the blade leading edge, a sufficient suction area for the centripetal fan is ensured without increasing the height of the unit, so that the unit is further thinned. That is, the air enters the centripetal fan at the blade leading edge and flows to the blade trailing edge. In this process, air is taken in also from the blade tip that couples, on the outer circumferential side, the blade leading edge with the blade trailing edge, although it is small in amount. On this account, the suction area is a fore portion of the blade leading edge. Thus, with the arrangement that the blade leading edge is slanted such that its tip side is present axially more on the discharge side of the unit than its hub side is, a larger suction area is ensured with a smaller axial height, compared with the case where the leading edge tip side is located axially more on the suction side of the unit than the leading edge hub side is.

Also by forming each blade into the configuration that its leading edge is three-dimensionally slanted toward the discharge side of the unit, a current of suction air is enabled to reach the hub side portion of the blade leading edge. In addition, the current of the suction air is allowed to smoothly proceed in the axial direction. Therefore, it is possible to prevent poor performance and big noise which would occurs due to the fact that a current of air proceeds through the blades considerably against the centrifugal force, as would be seen in the prior art (two-dimensional multi-wing centripetal fan).

In an embodiment, a planar suction guide member is provided on the suction side of the centripetal fan perpendicularly to a rotary shaft of the motor, and a cylindrical discharge guide member is provided on the discharge side of the centripetal fan concentrically with the rotary shaft.

In the air discharge unit of this constitution, air is take in from the radial outside smoothly by the action of the planar suction guide member on the suction side of the centripetal fan, while air is delivered, or blown, toward the outlet by the cylindrical discharge guide member on the discharge side of the fan. As a result of this, a smooth air flow is ensured for the centripetal fan, so that further reduction in pressure loss as well as in noise can be attained.

In an embodiment, an upstream-side cylinder start portion of the discharge guide member is positioned at a level between a leading edge tip side and a trailing edge tip side of each blade of the centripetal fan. That is, the discharge guide member begins at a level between the leading edge and trailing edge on the tip side of each blade in the centripetal fan. Therefore, a wide suction area for the centripetal fan is obtained. In this constitution, because the fan is not entirely housed in the duct, it is also possible to prevent any dead water regions from appearing around the outer circumferential portion of the fan blades. Thus, a good air flow is ensured.

In an embodiment, the discharge guide member has a suction air introducing means projecting radially outward from an upstream-side cylinder start portion.

In the air discharge unit of this constitution, since suction air is smoothly led to the discharge guide member by the suction air introducing means, pressure loss is further reduced. The suction air introducing means may be implemented, for example, by a bell mouth.

In an embodiment, an air flow guide member is placed close to and axially upstream of the discharge guide member, the air flow guide member separating a suction flow from a back flow against the suction flow.

In this constitution, for example, first in the open state, with the centripetal fan driven into rotation, a flow of air sucked radially sideways on the upstream side of the discharge guide member is blown out axially or obliquely axially toward the outer circumferential side of the fan while being accelerated by the blades of the fan.

As the flow is throttled gradually from the open state, the centrifugal force due to the rotation of the fan produces an increasing effect (i.e., the centrifugal force increasingly exceeds the axial force). Therefore, there arises a radially outward back flow near an intake of the discharge guide member. When a back flow of large disturbance is sucked in the centripetal fan again as it is, it would cause a deterioration in aerodynamic performance due to reduction of static pressure and an increase of noise in small and middle air volume zones. However, according to the present invention, such a back flow will be immediately blown away, in a state that the back flow is kept apart from the suction flow, through an air discharge path formed between the discharge guide member and the air flow guide member toward the upstream side of an air introduction passage leading to the centripetal fan. As a result, the suction flow is free from resistance of the back flow and from disturbance by the back flow, and a stable flow is thus obtained even in the small and middle flow regions, resulting in a further reduced pressure loss. Thus, the static pressure largely increases, and noise occurrence is also reduced.

In an embodiment, the hub of the centripetal fan has a discharge-side outer diameter larger than a suction-side outer diameter.

By thus making the discharge-side outer diameter of the hub larger than its suction-side outer diameter, the static pressure on the discharge side is enhanced, which enables an improvement in performance. More specifically, the total pressure of the fan is a sum of an increase in absolute speed (dynamic pressure), a decrease in relative speed (static pressure), and an increase in peripheral speed (static pressure) due to the centrifugal force. In the case of a centripetal fan, the radial size of a current of air is smaller when discharged out of the fan than when sucked in the fan. Therefore, the peripheral speed is inherently reduced, so that the static pressure tends to lower. On this account, it is preferable to increase the centrifugal force by directing the air flow outward by means of a slant of the hub, and thereby to increase the peripheral speed. This is realized by making the discharge-side outer diameter of the hub larger than its suction-side outer diameter, whereby the static pressure is enhanced. Then, with the static pressure enhanced, the rotational speed of the fan lowers, which in turn enables power saving, reduction in noise, and improvement in performance.

In an embodiment, the air discharge unit includes a discharge grille fitted into the outlet, and the discharge grille includes a grille frame engaged with the floor panel, a plurality of grille rings placed inside the grille frame so as to be concentric with and radially spaced from one another, and radial ribs joining the grille rings to the grille frame. The radial ribs are slanted forward in a direction of revolution of a discharge air flow with respect to a vertical line.

In the air discharge unit of this constitution, since the radial ribs provided in the discharge grille are slanted forward in the rotational direction of discharged air flow with respect to the vertical line, the rotational current of discharged air flowing toward the outlet passes by the radial ribs without being subjected to great resistance from the radial ribs. Because no great resistance is given at the outlet like this, the pressure loss on the discharge side is further reduced. Furthermore the air noise is reduced.

In another embodiment, part of the motor is housed within the hub.

This constitution allows the motor to be less projected heightwise of the unit by an amount in which the motor is partially housed in the hub, than in the case where the motor is disposed entirely outside the centripetal fan. As a result, the unit height is further reduced.

Furthermore, if the motor is supported on the discharge side of the centripetal fan, a grille or the like disposed on the discharge side can be utilized for supporting the motor. This allows the unit to be even more thinned with a simple construction. In an embodiment, for example, the discharge grille further includes, radially inside of the plurality of grille rings, a center cylinder which extends axially. An end portion of the motor is housed within the hub and an opposite end portion of the motor is fitted into the center cylinder. Therefore, the unit height is lessened, so that this air discharge unit can be installed even in an underfloor space having a small height.

In an embodiment, a suction fan for sucking room air is disposed to and on a suction side of the centripetal fan.

In the air discharge unit of this constitution, in the cooling mode (Assume that, for maintaining an environment of a 26° C. room temperature, for example, conditioned air of a temperature of 20° C. is fed from the air conditioner into the underfloor chamber and discharged into the room by the centripetal fan), room air is taken in the suction side of the centripetal fan by the adjacent suction fan, and mixed with the air having a lower temperature in the chamber under a free access floor. Thereafter, the mixed air is discharged into the room. Thus, it is possible to prevent overcooling of the discharged air to thereby reduce cold draft in the cooling mode without using a heater.

In an embodiment, the suction fan is constituted of a second centripetal fan rotatable forward and backward, and the two centripetal fans are housed in a casing.

In this case, rotating both of the two centripetal fans forward allows a large volume of air to be discharged. On the other hand, the backward rotation of the second centripetal fan, which is rotatable forward and backward, provides a good mixture of the room air and the air of the underfloor chamber under a free access floor. Thus, with this simple and proper construction, it is possible to prevent overcooling of the discharged air to thereby reduce cold draft in the cooling mode successfully.

Furthermore, the present invention provides an underfloor air-conditioning system comprising an air discharge unit according to any one of the foregoing embodiments. This underfloor air-conditioning system includes, in addition to any one of the above mentioned air discharge units, an underfloor chamber formed between a floor slab and a floor panel, an air conditioner, means for feeding conditioned air from the air conditioner to the underfloor chamber, and means for returning room air to the air conditioner.

In an embodiment, the means for returning room air to the air conditioner has an inlet provided in a ceiling. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
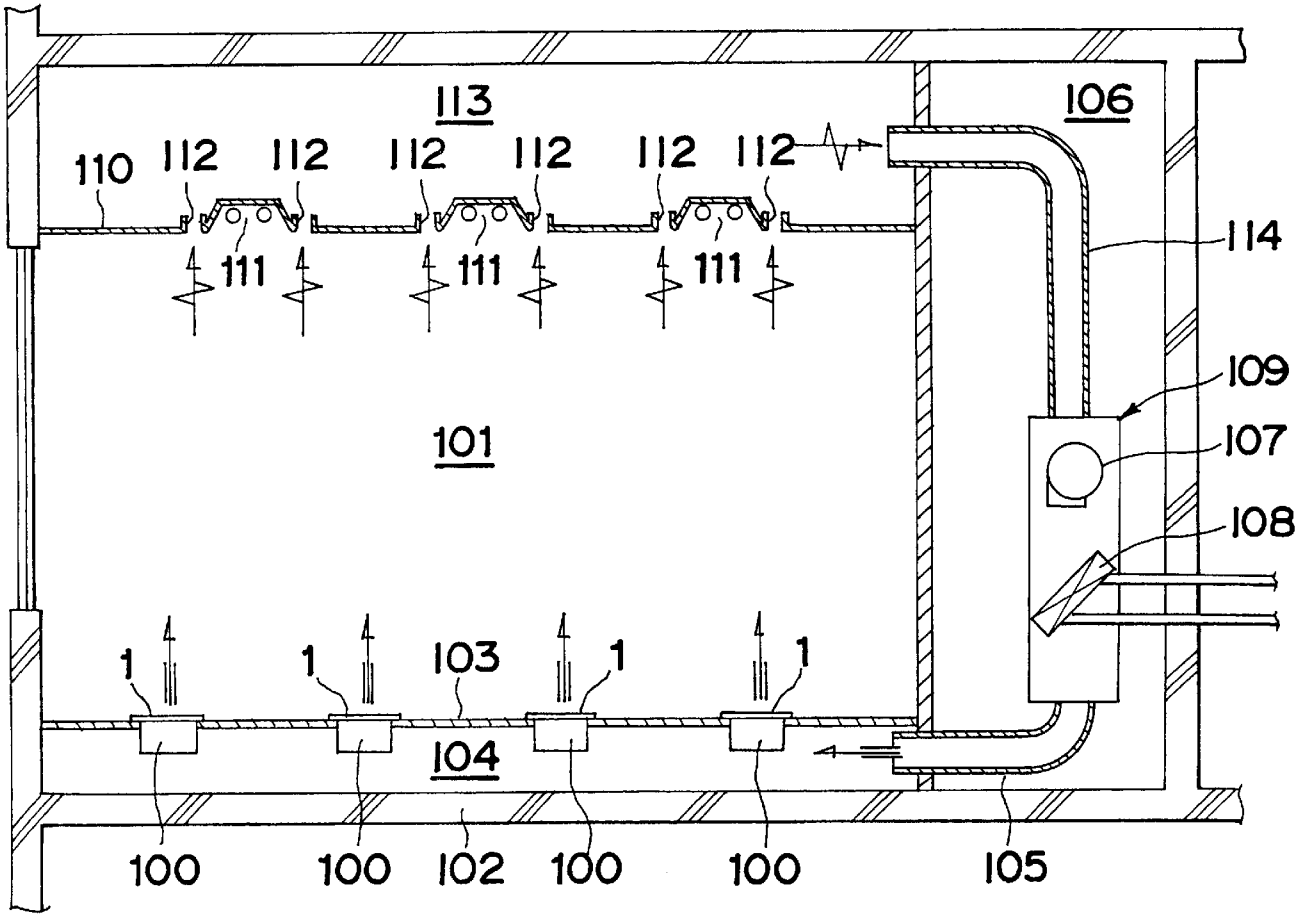
FIG. 1 is a schematic sectional view of the whole underfloor air-conditioning system according to the present invention.

FIG. 1 schematically shows a whole underfloor air-conditioning system which is an embodiment of the present invention. A floor panel 103 is provided above a floor slab 102 of an office room 101, and an underfloor chamber 104 is formed below the floor panel 103. A plurality of outlets 1 are dispersedly provided at appropriate locations of the floor panel 103, and air discharge units 100 are provided in correspondence to the outlets 1, respectively. Cool air or warm air is fed from an air conditioner 109 installed in an air-conditioner room 106 to the underfloor chamber 104 through a feed duct 105. The air conditioner 109 in this embodiment has a bottom discharge fan 107 and a cool/warm water coil 108. A refrigerant coil may also be used instead of the cool/warm water coil 108. On a ceiling 110, slit inlets 112 are provided on opposite sides of each of illuminators 111 in order that air is turned back to the air conditioner 109 through the inlets 112 and then through a vacancy 113 in the ceiling and a return duct 114.

Next, the air discharge unit 100 is described in detail.

Figure 2:
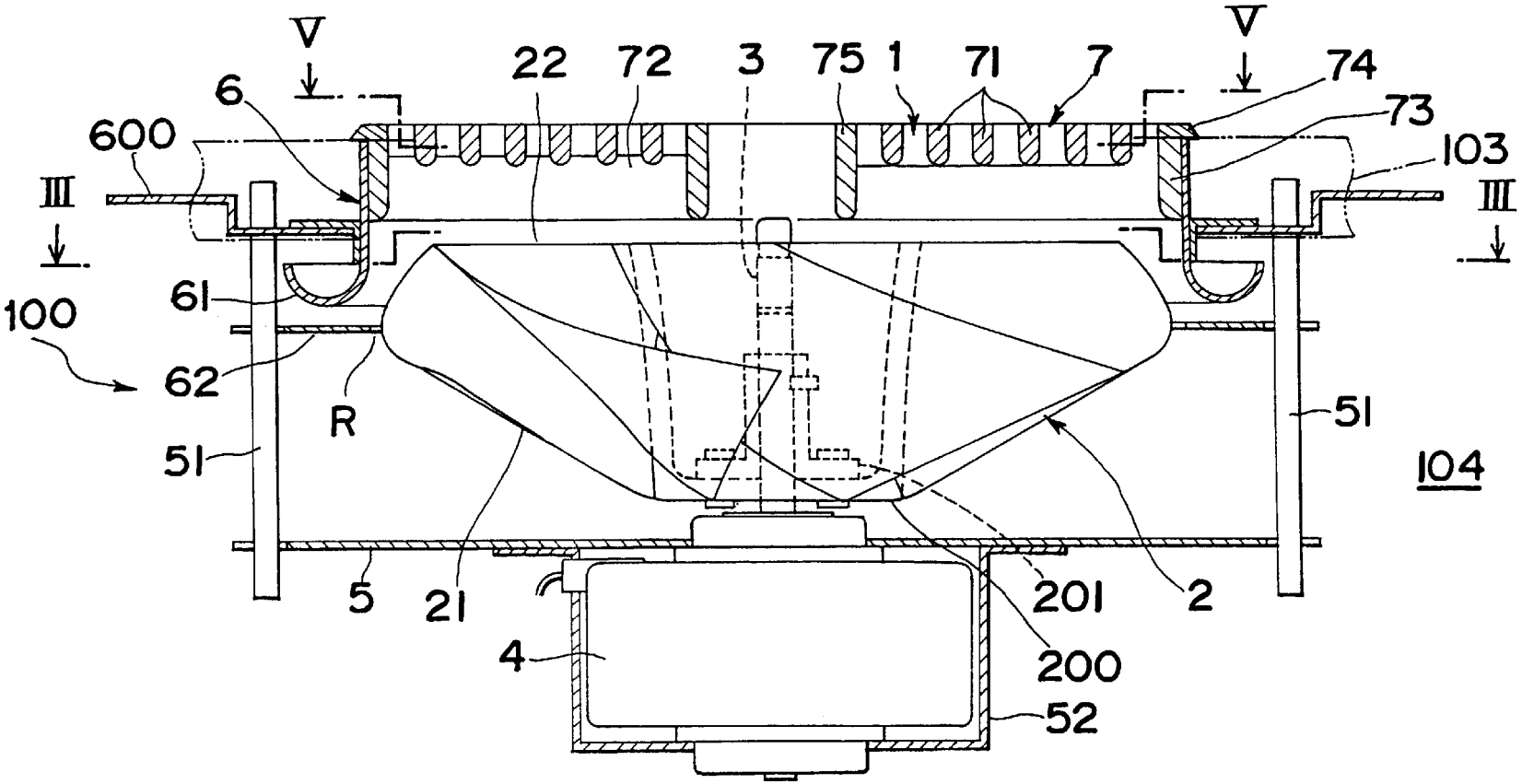
FIG. 2 is a sectional view showing a first embodiment of the air discharge unit used in the underfloor air-conditioning system of FIG. 1.
Figure 3:
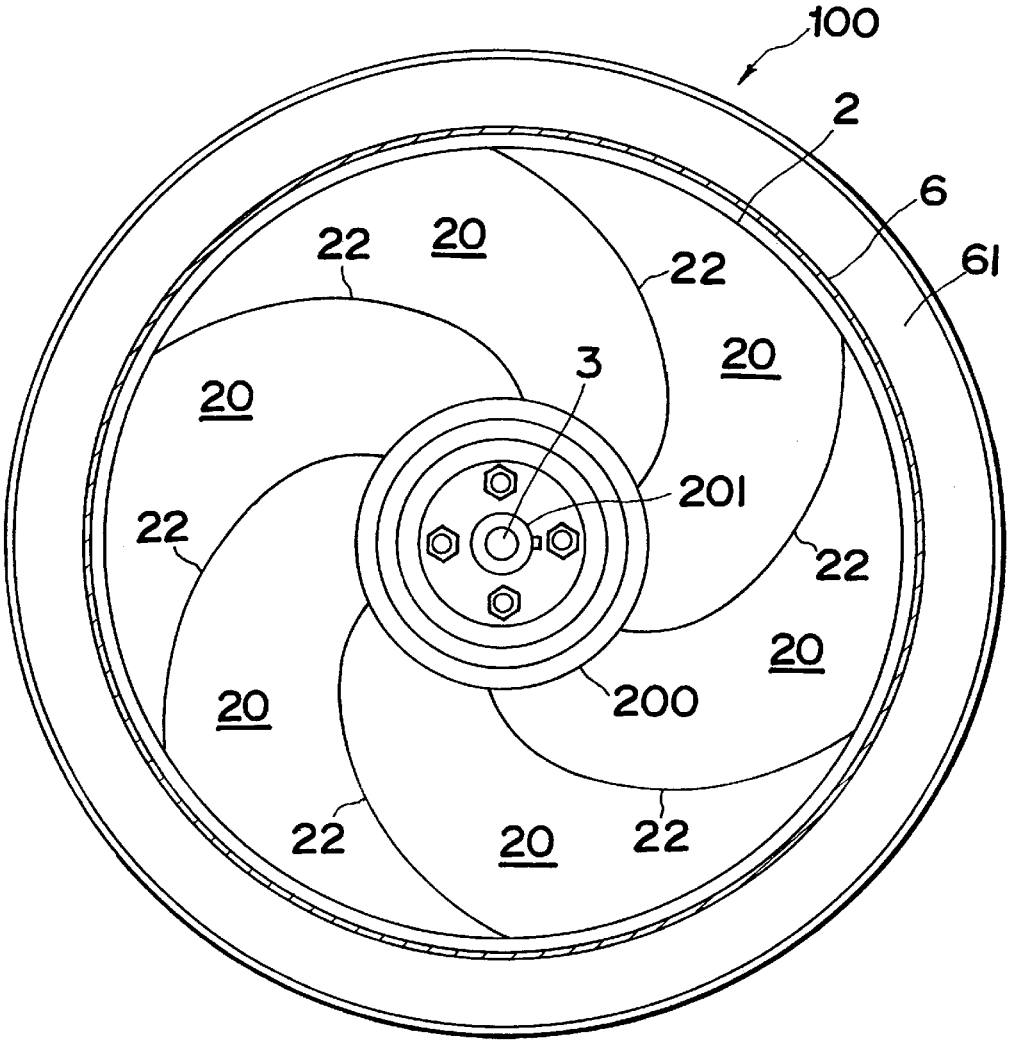
FIG. 3 is a sectional view taken along the line III—III of FIG. 2.
Figure 4:
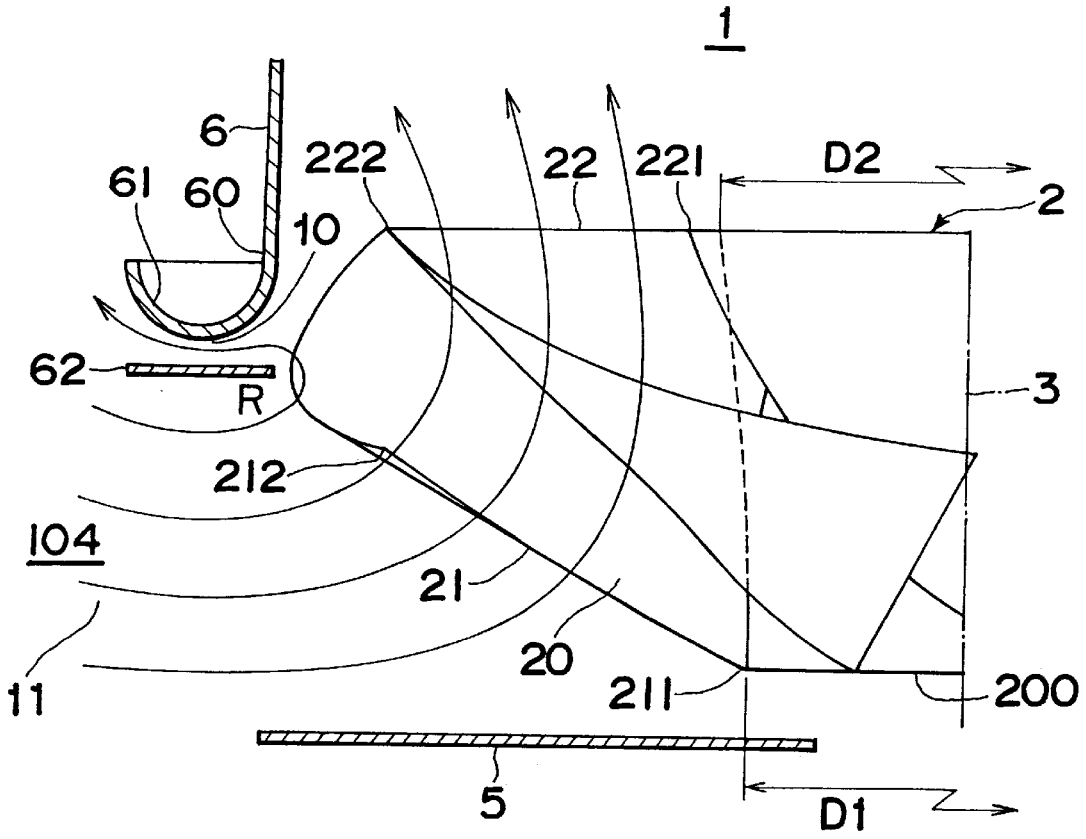
FIG. 4 is an enlarged sectional view of an essential part of FIG. 2.

The air discharge unit 100, as shown in FIGS. 2 to 4, is equipped with a centripetal fan 2 which sucks air within the underfloor chamber 104 from a radially outside direction and forces the air to flow generally axially toward the outlet 1.

This centripetal fan 2, as shown in FIG. 3, has six blades 20 on an outer surface of a bottomed cylindrical hub 200, the outer surface forming a generally hyperboloid of one sheet. The hub 200 is designed so that, as shown in FIG. 4, its upper, discharge-side outer diameter D2 is larger than its lower, suction-side outer diameter D1, with a view to increasing the static pressure on the discharge side. A boss 201 is mounted inward of the hub 200, and a rotary shaft 3 extending from a motor 4 is coupled to this boss 201. As an alternative to the generally hyperboloid of one sheet, the outer surface of the hub 200 may assume a linear surface, which is an ultimate form of the hyperboloid of one sheet.

As shown in FIG. 4, a blade leading edge 21 of the centripetal fan 2 is slanted so that the distance from the blade leading edge to a blade trailing edge 22 decreases gradually from a central, hub side 211 to an outer circumferential, tip side 212. The blade trailing edge 22 extends horizontally from a central, hub side 221 to an outer circumferential, tip side 222.

The blade leading edge of each blade of the centripetal fan is slanted so that the tip-side portion thereof is located axially more on the discharge side and radially more outside than the hub-side portion thereof is. That is, the blade leading edge is three-dimensionally slanted toward the discharge side so that the blade scoops up air and discharges the air slightly toward the center. As a result, a current of suction air can reach the hub-side portion of the blade leading edge, and the suction air current is made to smoothly flow in the axial direction. Accordingly, deterioration in performance and increase of noise due to an air current flowing within the blades greatly against the centrifugal force, as would occur conventionally (with a two-dimensional multi-wing centripetal fan), is avoided.

On the suction side of the centripetal fan 2 is disposed a suction guide member 5 shaped into a flat plate, perpendicularly to the rotary shaft 3. This suction guide member 5, as shown in FIG. 2, is supported by means of studs 51 erectly provided below the floor panel 103. In addition, the motor 4 is housed in a motor casing 52 fixed to a lower surface of the suction guide member 5.

On the discharge side of the centripetal fan 2 is disposed a discharge guide member 6 shaped into a cylindrical form coaxial with the rotary shaft 3. This discharge guide member 6 is supported on the floor panel 103 by means of a radial bracket 600.

As shown in FIG. 4, an upstream-side cylinder start portion 60 of the discharge guide member 6 is positioned at a level between the tip-side leading edge 212 and the tip-side trailing edge 222 of each blade of the centripetal fan 2. From the cylinder start portion 60 is continued an annular bell mouth 61 projecting radially outwardly and being generally semicircular in cross section. The bell mouth serves as a suction air introducing means. This bell mouth 61 leads the suction air smoothly into the discharge guide member 6 by virtue of its configuration, so that pressure loss is reduced.

It is noted that provision of the suction air introducing means is not essential, although it is preferable to provide such means as in this embodiment. Further, besides a shape having a curved cross section like the bell mouth 61 of this embodiment, the suction air introducing means can be formed into a shape which radially outwardly projects only horizontally without being curved at all, although not shown.

In proximity to and on the axially upstream side of the discharge guide member 6, an annular, flat-plate air flow guide member 62 is provided so as to form an air outflow space 10 between the bell mouth 61 and the air flow guide member 62. This air flow guide member 62 is supported on the studs 51 like the suction guide member 5. The air flow guide member 62 operates to promptly and recirculatively return back-flow components which may be generated in an air suction area R near the bell mouth 61 of the discharge guide member 6, through the air outflow space 10, to the upstream side of an air introducing path 11 leading to the discharge guide member 6, in a state that the back-flow components are kept apart from the current of suction air flowing between the air flow guide member 62 and the suction guide member 5. In this way, the air flow guide member 62 functions to prevent the back-flow components from flowing back to the suction air flow. That is, the air flow guide member 62 separates the suction flow from the back flow against the suction flow.

Therefore, in the air discharge unit 100 using the centripetal fan 2 and equipped with the air flow guide member 62, for example, even if the flow is throttled from the open state, there no longer occurs a back flow phenomenon in proximity to the air suction area R of the discharge guide member 6. This is further explained below.

With the above constitution, first in the open state, with the motor 4 driven so that the centripetal fan 2 is rotated, a flow of air sucked radially sideways through the air introducing path 11 via the bell mouth 61 of the discharge guide member 6 is blown out axially or obliquely outward while being accelerated by the blades 20. However, as the flow is gradually throttled from the open state, there occurs a back flow directed radially outward, as shown in FIG. 4, in the air intake area R in proximity to the discharge guide member 6 because of an effect of an increasing centrifugal force. This back flow, however, is blown out immediately toward the upstream side of the air introducing path 11 through the air outflow path 10 formed between the bell mouth 61 of the discharge guide member 6 and the air flow guide member 62. As a result, a stable air flow is obtained even in small and middle air volume zones, so that the static pressure largely increases and the noise is reduced.

Figure 10:
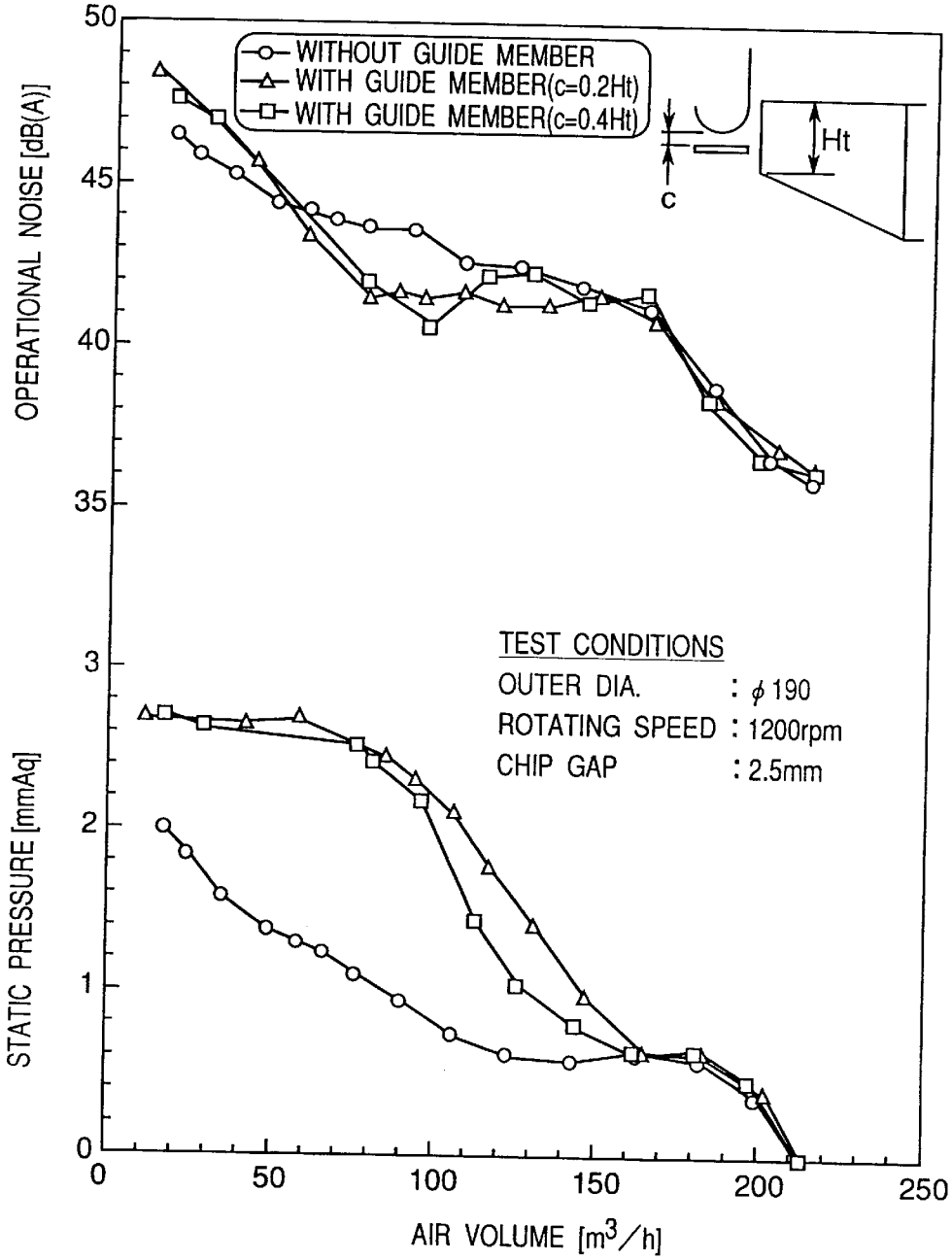
FIG. 10 is a graph showing effects of the air discharge unit of FIG. 2, in comparison with a comparative example.

FIG. 10 indicates an improvement in blowing performance by the air discharge unit 100 according to this embodiment having the air outflow path 10 formed by the air flow guide member 62, in comparison with a comparative example having no air outflow path 10, with respect to a single centripetal fan 2. It is noted that, in FIG. 10, the air flow guide member 62 is represented simply as a guide member. From the contents of FIG. 10, it is obvious that aerodynamic performance and noise performance in small and middle air volume zones have been improved to a large extent with the constitution of this embodiment.

Although the air flow guide member 62 is formed into a flat-plate shape in this embodiment, a better flow of air is attained by forming one end portion or both end portions of the member into a shape having an arcuate cross section.

Figure 11:
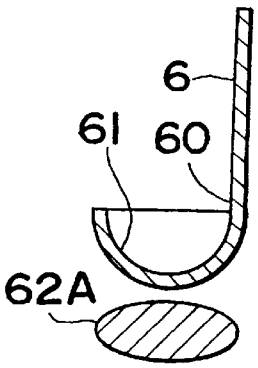
FIG. 11 is a sectional view showing another example of the air flow guide member.
Figure 12:
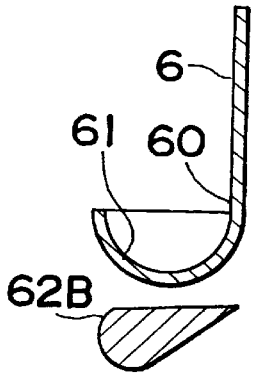
FIG. 12 is a sectional view showing still another example of the air flow guide member.

For example, an air flow guide member 62A shown in FIG. 11 has a generally flat elliptical shape in cross section, in which end portions of the guide member upstream and downstream of the air flow through the air introducing path 11 are formed into a cross sectional shape of an arc having a specified radius of curvature. Also, an air flow guide member 62B shown in FIG. 12 has a shape in cross section of an arc having a specified radius of curvature at one end upstream of the air flow through the air introducing path 11, the thickness of the member being gradually reduced from the upstream side toward the downstream side so that the member is formed with an edge on the downstream side. Both of the air flow guide members 62A, 62B are capable of reducing the inherent disturbances of suction air flow also separating back flow components more easily, as compared with the flat-plate air flow guide member 62. Accordingly, further improvement in performance and further noise reduction can be attained.

Figure 19:
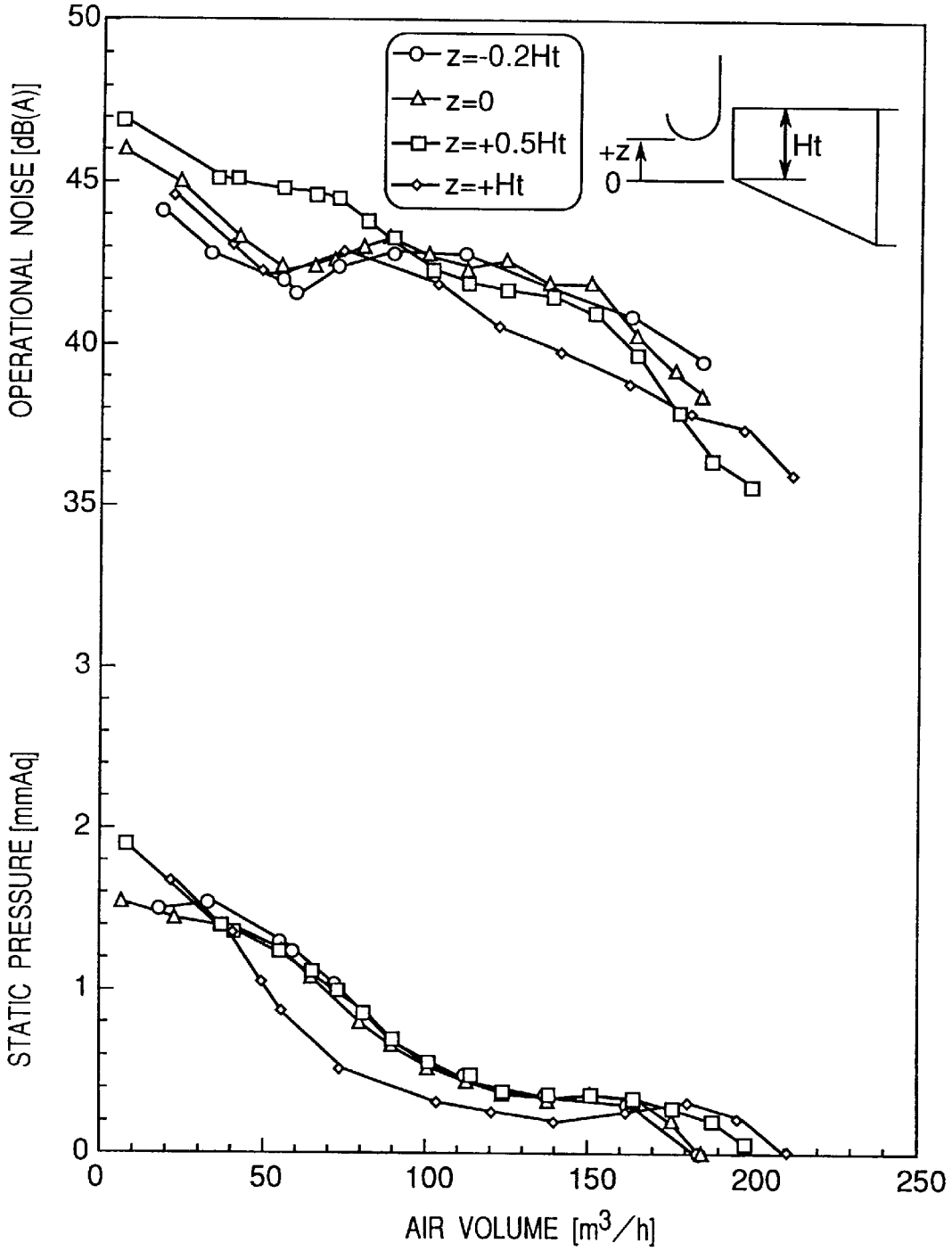
FIG. 19 is a graph showing problems caused by a method of preventing occurrence of back flow.

As means for solving the back flow issue, it might be conceivable that the cylindrical portion of the discharge guide member 6 is extended rearward with respect to the discharge direction so as to enclose and conceal the tip portion of each blade 20 of the centripetal fan 2, instead of providing the air flow guide member 62, 62A, or 62B, to thereby prevent back flow itself from occurring. Indeed such an arrangement can prevent the back flow from occurring, but the area of suction by the centripetal fan 2 is reduced so that the air delivery ability in large air flow regions would be reduced as can be seen from the graph of FIG. 19. Further, there would occur a so-called dead water region in an outer circumferential part of the centripetal fan 2. Accordingly, such means is undesirable. The present embodiment does not intend to prevent occurrence of back flow itself by concealing the tip portion of each blade, but uses the air flow guide member 62, 62A, or 62B to allow a back flow that has occurred to be blown out to the upstream side of the air introducing path 11 in a state that the back flow is kept apart from the suction flow. Accordingly, the problems of deterioration in the air delivery ability and dead water regions do not occur.

Figure 5:
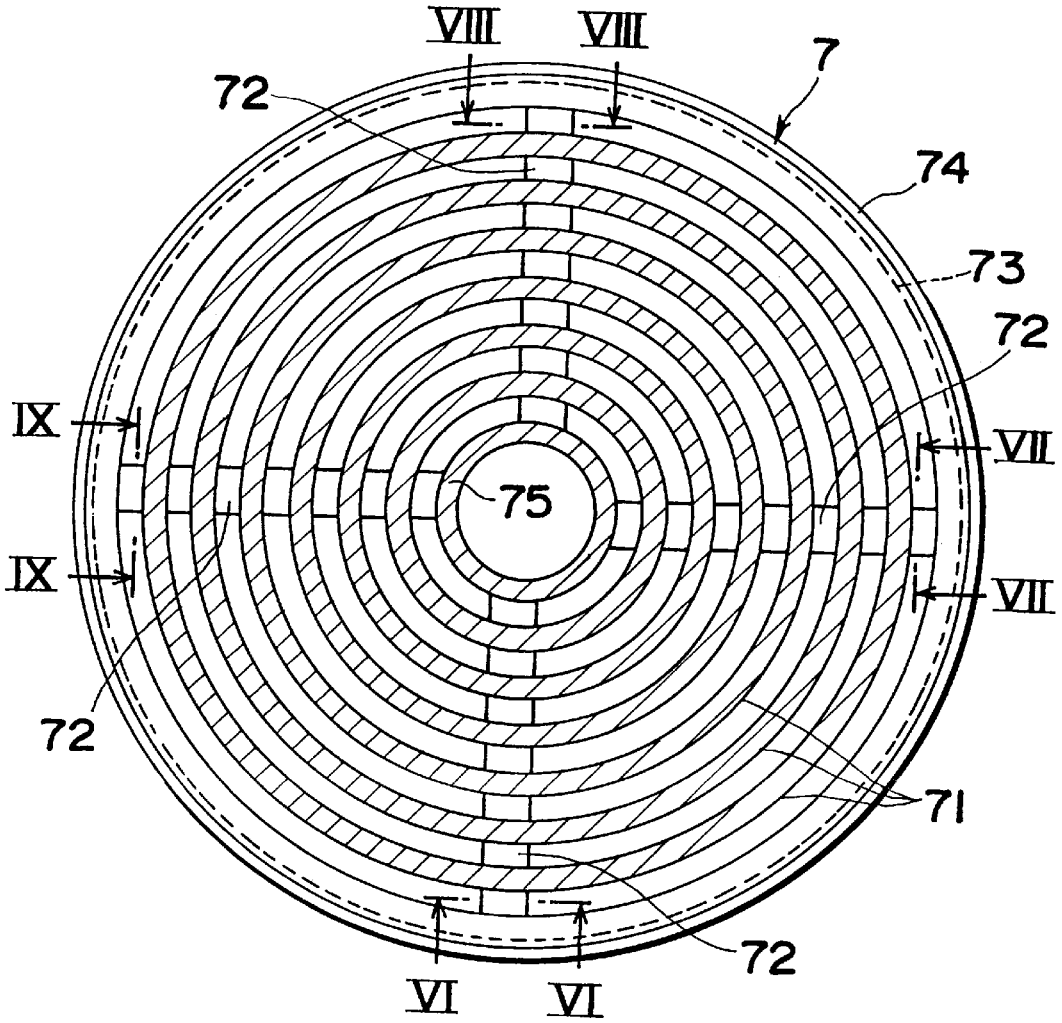
FIG. 5 is a sectional view taken along the line V—V of FIG. 2.
Figure 6:
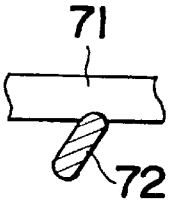
FIG. 6 is a sectional view taken along the line VI—VI of FIG. 5.
Figure 7:
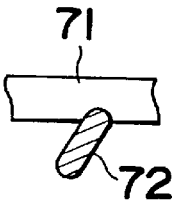
FIG. 7 is a sectional view taken along the line VII—VII of FIG. 5.
Figure 8:
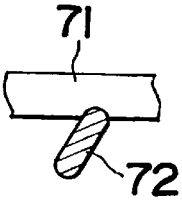
FIG. 8 is a sectional view taken along the line VIII—VIII of FIG. 5.
Figure 9:
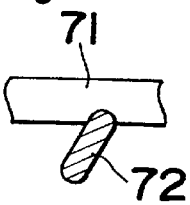
FIG. 9 is a sectional view taken along the line IX—IX of FIG. 5.

Into the circular outlet 1, as shown in FIGS. 2 and 5, a circular discharge grille 7 made of resin is fitted. This discharge grille 7 has a cylindrical grille leg 73 to be fitted into the cylinder portion of the discharge guide member 6, a grille frame 74 integrated with the grille leg 73, a center cylinder 75 having a lower end surface flush with the lower end surface of the grille leg 73 and an upper end surface flush with the upper end surface of the grille frame 74, a plurality of grille rings 71 disposed concentrically between the center cylinder 75 and the grille frame 74 or the grille leg 73, and radial ribs 72 coupling these grille rings 71 to the center cylinder 75 and the grille leg 73 at four circumferential locations. A radially outer portion of the grille frame 74 projects from the grille leg 73 so as to be engaged with the floor panel 103. Also, as shown in FIGS. 6 to 9, each radial rib 72 is slanted forward in the rotational direction of the flow of discharge air with respect to the vertical line (where the angle of slant is approximately 30 degrees with respect to the vertical line in this example). The slant of the radial ribs 72 allows the rotational flow directed toward the outlet 1 to slip through the radial ribs 72 without being subjected to any great resistance by the radial ribs 72. Thus, pressure loss at the outlet is reduced, and air noise is also reduced.

Figure 13:
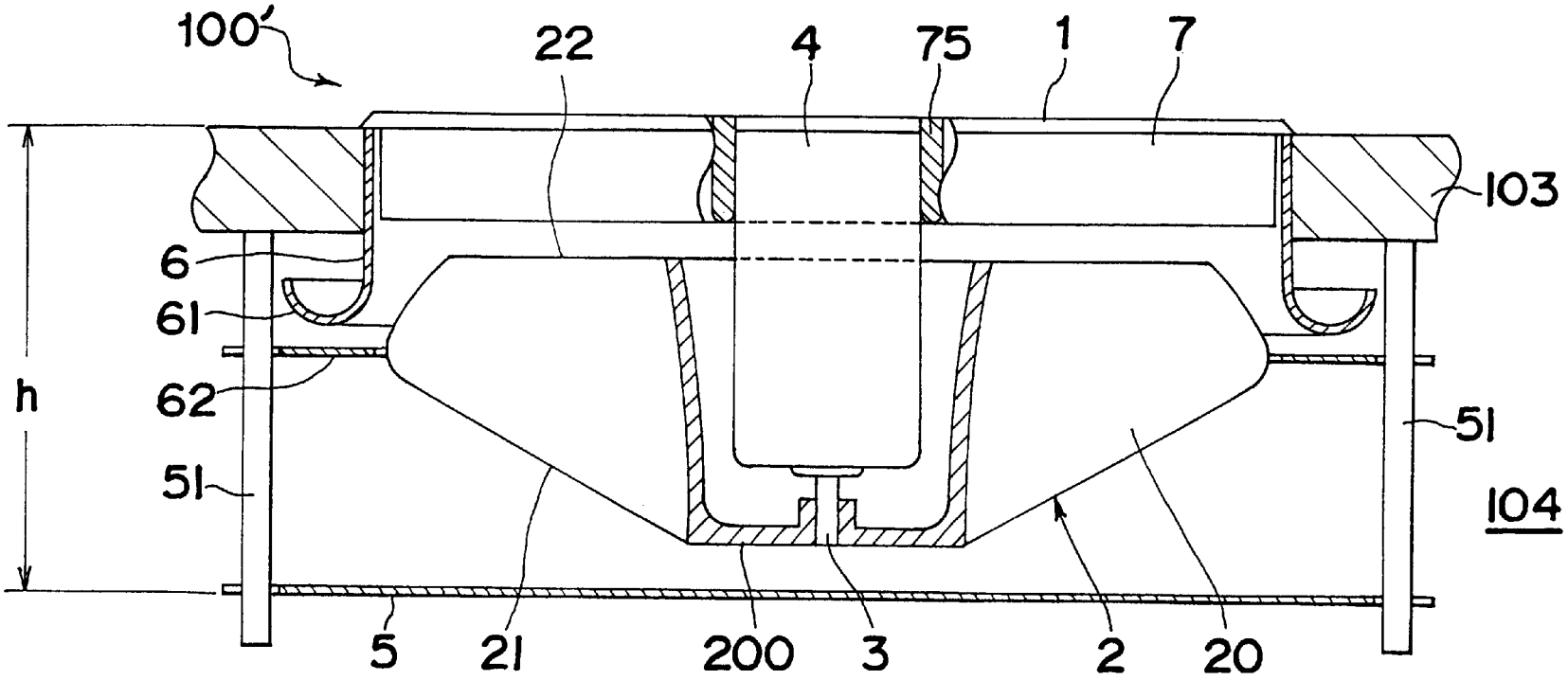
FIG. 13 is a sectional view showing a second embodiment of the air discharge unit used in the underfloor air-conditioning system of FIG. 1.

FIG. 13 shows an air discharge unit 100' which can be used in place of the air discharge unit 100 used in the underfloor air-conditioning system of FIG. 1. In FIG. 13, components similar to those of FIGS. 2 to 4 and FIG. 5 are designated by the same reference numerals.

This air discharge unit 100' differs from the air discharge unit 100 according to the first embodiment in that the motor 4 is installed at a different place. The motor 4 is provided below the centripetal fan 2 in the air discharge unit 100, while the motor 4 is housed inside the hub 200 in the air discharge unit 100'. An upper portion of the motor 4 projecting from the hub 200 is accommodated in and supported by the center cylinder 75 of the discharge grille 7 which is disposed above the hub 4. In the case of such a structure, the motor 4 desirably has a smaller outer diameter, and it is preferable to adopt a DC motor and not an AC motor such as induction motors. This is because a DC motor can be provided in smaller size than an AC motor having the same output, so that almost the entire motor can be housed in the hub 200. In this case, a distance h from the suction guide member 5 to the floor panel 103 can be reduced to 100 mm.

Figure 14:
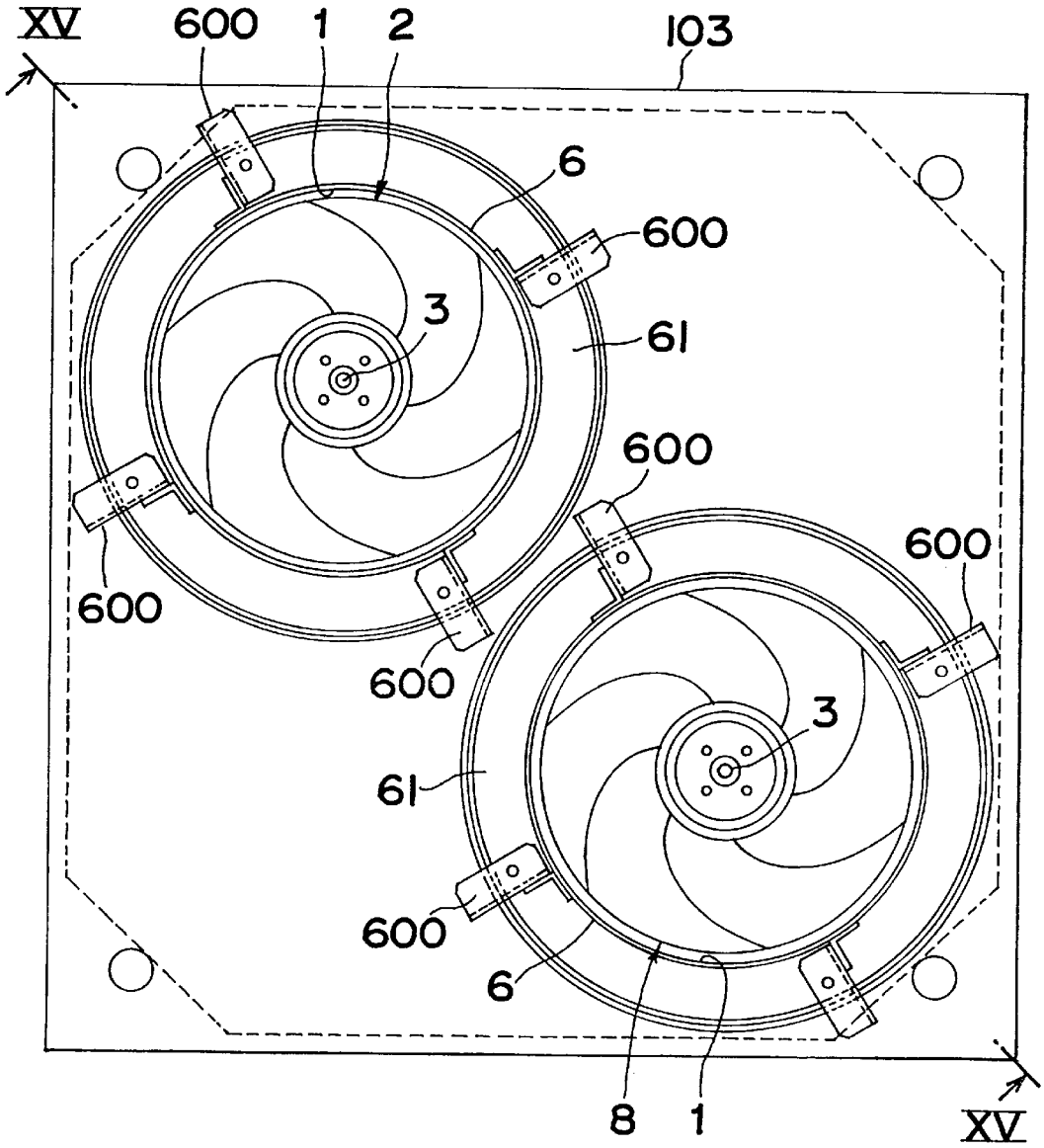
FIG. 14 is a plan view of a third embodiment of the air discharge unit used in the underfloor air-conditioning system of FIG. 1, as viewed with a discharge grille removed.
Figure 15:
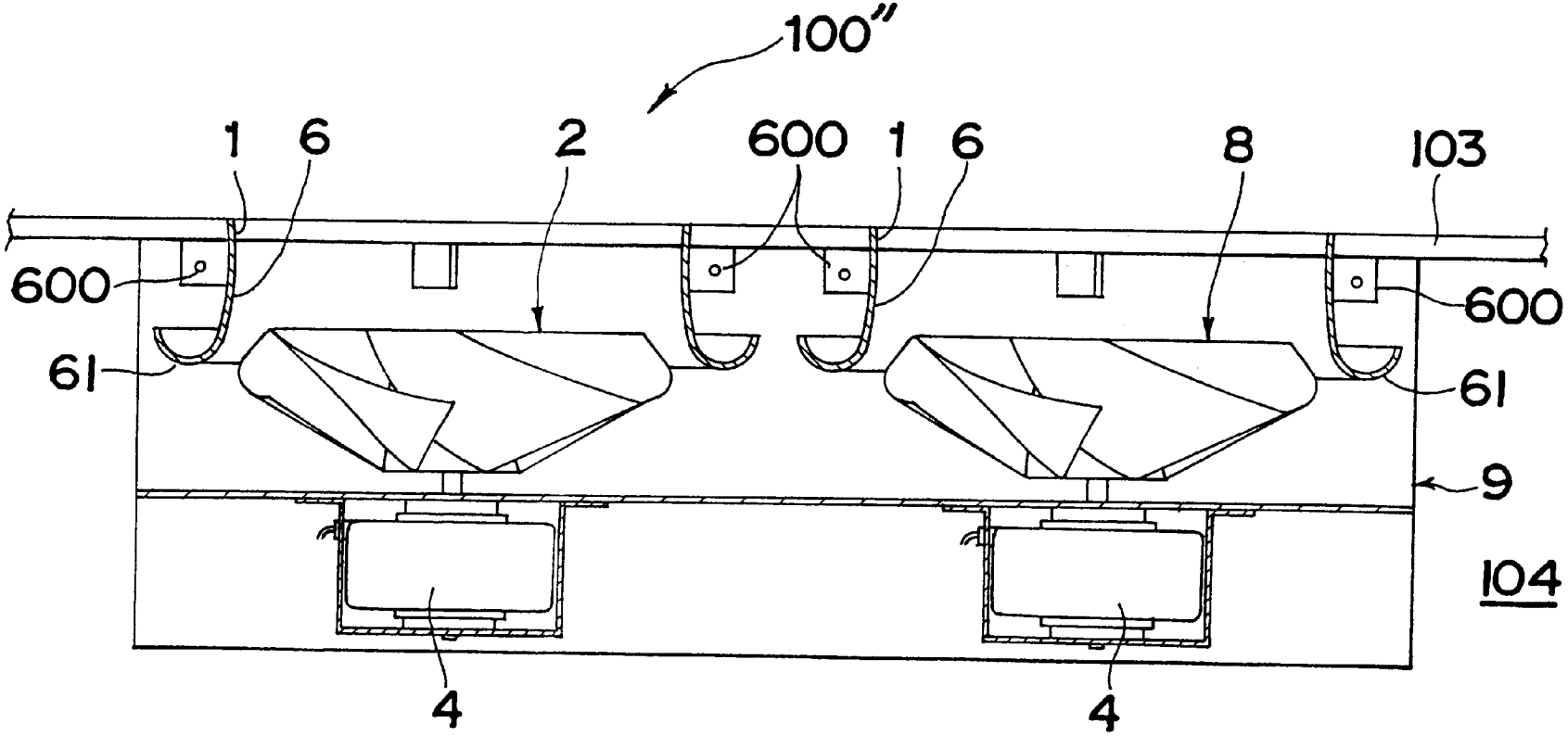
FIG. 15 is a sectional view taken along the line XV—XV of FIG. 14.
Figure 16:
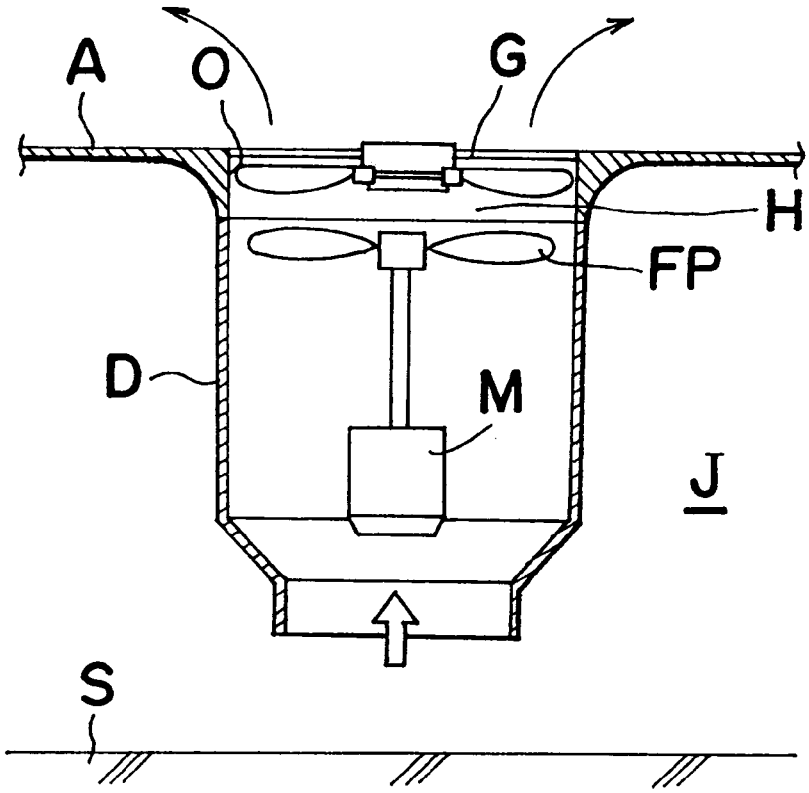
FIG. 16 is a sectional view of the air discharge unit according to the prior art.
Figure 17:
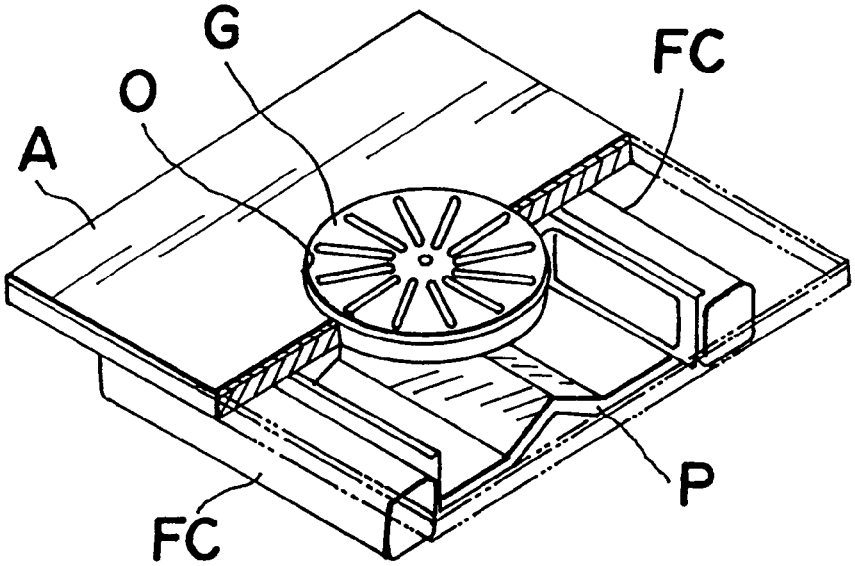
FIG. 17 is a sectional view of another air discharge unit according to the prior art.
Figure 18:
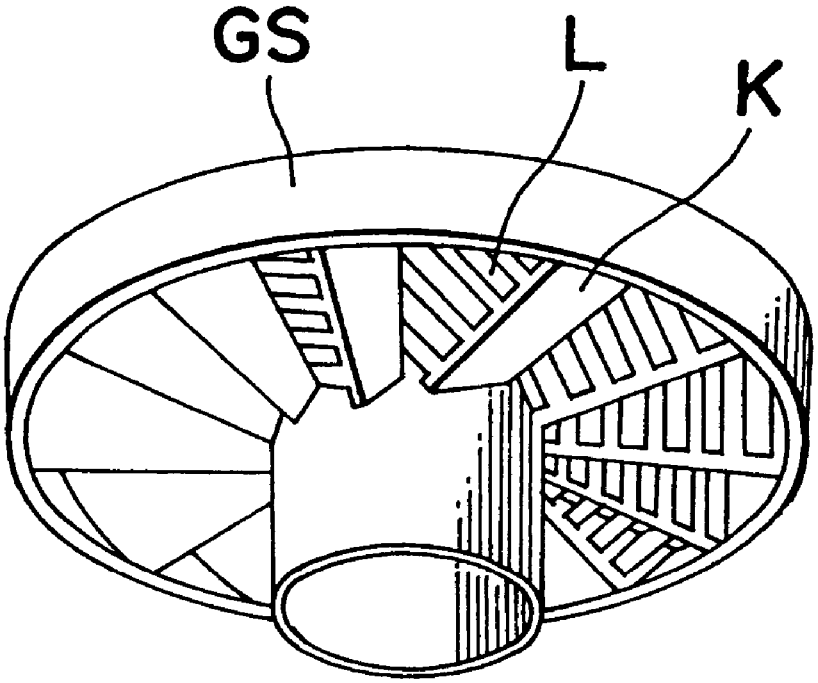
FIG. 18 is a sectional view showing a prior art discharge grille.

FIGS. 14 and 15 show still another air discharge unit 100" which can be employed instead of the air discharge unit 100 used in the underfloor air-conditioning system of FIG. 1. In FIGS. 14 and 15, components similar to those of FIGS. 2 to 4 and FIG. 5 are designated by the same reference numerals.

In this air discharge unit 100", a suction fan 8 for sucking room air is disposed adjacent to and on the suction side of the centripetal fan 2. The centripetal fan in this embodiment is of the same construction as the centripetal fan 2 of the air discharge units 100 and 100' shown in FIGS. 2 to 4 and FIG. 13, respectively. For the suction fan 8, a second centripetal fan is employed, which has the same construction as the centripetal fan 2 and is rotatable in opposite directions, or forward and backward. These two centripetal fans 2, 8 are housed in a casing 9 provided below the floor panel 103. The casing 9 is opened at its sides.

This air discharge unit 100" is enabled to blow or discharge a large volume of air when both centripetal fans 2, 8 are rotated forward. Also, in the cooling mode, the reverse rotation of the centripetal fan 8 provides a good mixture of room air sucked through the outlet 1 (serving as a suction inlet in this case) and air in the underfloor chamber 104 of a temperature lower than room temperature. Thus, the discharged air is prevented from being cooled too much, and the cold draft in the cooling mode is reduced successfully.

INDUSTRIAL APPLICABILITY

The air discharge unit for underfloor air conditioning and the underfloor air-conditioning system according to the present invention are applicable in offices, computer rooms, various laboratories, stores, factories, hospitals, hotels, banquet halls, and other building facilities in various fields. In particular, they are suitable for use in places that cannot afford a large underfloor space.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An air discharge unit for underfloor air conditioning comprising:

an outlet provided in a floor panel; a centripetal fan which has a hub and a plurality of blades formed on an outer surface of said hub; and which is disposed opposite to said outlet and within an underfloor chamber formed between said floor panel and a floor slab, and which, in operation, sucks therein air in said underfloor chamber from radially outside and delivers the sucked air generally axially toward said outlet; and a motor for driving said centripetal fan into rotation.

2. The air discharge unit for underfloor air conditioning according to claim 1, wherein a leading edge of each blade of said centripetal fan is slanted such that a leading edge tip side is located axially more on discharge side of said fan and radially more outside than a leading edge hub side is.

3. The air discharge unit for underfloor air conditioning according to claim 1, further comprising:

a planar suction guide member provided on suction side of the centripetal fan perpendicularly to a rotary shaft of said motor; and a cylindrical discharge guide member provided on discharge side of the centripetal fan concentrically with said rotary shaft.

4. The air discharge unit for underfloor air conditioning according to claim 3, wherein an upstream-side cylinder start portion of said discharge guide member is positioned at a level between a leading edge tip side and a trailing edge tip side of each blade of said centripetal fan.

5. The air discharge unit for underfloor air conditioning according to claim 3, wherein said discharge guide member has a suction air introducing means projecting radially outward from an upstream-side cylinder start portion.

6. The air discharge unit for underfloor air conditioning according to claim 3, wherein an air flow guide member is placed close to and axially upstream of said discharge guide member, said air flow guide member separating a suction flow from a back flow against the suction flow.

7. The air discharge unit for underfloor air conditioning according to claim 1, wherein said hub of said centripetal fan has a discharge-side outer diameter larger than a suction-side outer diameter.

8. The air discharge unit for underfloor air conditioning according to claim 1, further comprising a discharge grille fitted into said outlet, said discharge grille comprising:

a grille frame engaged with said floor panel a plurality of grille rings placed inside said grille frame so as to be concentric with and radially spaced from one another; and radial ribs joining said grille rings to said grille frame, wherein said radial ribs are slanted forward in a direction of revolution of a discharge air flow with respect to a vertical line.

9. The air discharge unit for underfloor air conditioning according to claim 1, wherein part of said motor is housed within said hub.

10. The air discharge unit for underfloor air conditioning according to claim 9, wherein said motor is supported on a discharge side of said centripetal fan.

11. The air discharge unit for underfloor air conditioning according to claim 8, wherein said discharge grille further comprises, radially inside of said plurality of grille rings, a center cylinder extending axially, and an end portion of said motor is housed within said hub and an opposite end portion of said motor is fitted into said cylinder.

12. The air discharge unit for underfloor air conditioning according to claim 1, wherein a suction fan for sucking room air is disposed in adjacency to and on a suction side of said centripetal fan.

13. The air discharge unit for underfloor air conditioning according to claim 12, wherein said suction fan is constituted of a second centripetal fan rotatable forward and backward, and the two centripetal fans are housed in a casing.

14. An underfloor air-conditioning system comprising:

an underfloor chamber formed between a floor slab and a floor panel;

an air conditioner, means for feeding conditioned air from said air conditioner said underfloor chamber;

an air discharge unit for underfloor air conditioning for discharging the conditioned air fed to said underfloor chamber, into a room the air discharge unit comprising: an outlet provided in a floor panel;

a centripetal fan which has a hub and a plurality of blades formed on an outer surface of said hub, and which is disposed opposite to said outlet and within an underfloor chamber formed between said floor panel and a floor slab, and which, in operation, sucks therein air in said underfloor chamber from radially outside and delivers the sucked air generally axially toward said outlet; and a motor for driving said centripetal fan into rotation; and means for returning room air to said air conditioner.

15. The underfloor air-conditioning system according to claim 14, wherein said means for returning room air to the air conditioner has an inlet provided in a ceiling.

* * * * *